US012220010B2

(12) United States Patent
Villarreal

(10) Patent No.: US 12,220,010 B2
(45) Date of Patent: Feb. 11, 2025

(54) GRIP SPORTING ACCESSORY

(71) Applicant: Fernando Villarreal, Tomball, TX (US)

(72) Inventor: Fernando Villarreal, Tomball, TX (US)

( * ) Notice: Subject to any disclaimer, the term of this patent is extended or adjusted under 35 U.S.C. 154(b) by 0 days.

(21) Appl. No.: 18/310,126

(22) Filed: May 1, 2023

(65) Prior Publication Data

US 2023/0371628 A1 Nov. 23, 2023

Related U.S. Application Data

(60) Provisional application No. 63/342,682, filed on May 17, 2022.

(51) Int. Cl.

| | |
|---|---|
| ***A41D 19/015*** | (2006.01) |
| ***A63B 71/14*** | (2006.01) |
| *A63B 102/18* | (2015.01) |

(52) U.S. Cl.

CPC ..... *A41D 19/01547* (2013.01); *A63B 71/143* (2013.01); *A41D 2400/80* (2013.01); *A63B 2102/18* (2015.10); *A63B 2102/182* (2015.10); *A63B 2209/08* (2013.01); *A63B 2209/10* (2013.01)

(58) Field of Classification Search

CPC ..... A63B 71/146; A63B 71/148; A41D 19/01547

See application file for complete search history.

(56) References Cited

U.S. PATENT DOCUMENTS

| | | | | |
|---|---|---|---|---|
| 3,274,616 | A | 9/1966 | Russo | |
| 3,421,160 | A * | 1/1969 | Domenico | A63B 71/148 473/59 |
| 3,496,573 | A * | 2/1970 | Pope | A63B 71/148 473/59 |
| 3,835,472 | A * | 9/1974 | Duggins | A63B 71/148 473/59 |
| 3,918,097 | A | 11/1975 | Mlodoch | |
| 5,218,719 | A | 6/1993 | Johnson | |
| 5,330,391 | A * | 7/1994 | Mitchell | A63B 71/148 473/59 |
| 5,604,934 | A | 2/1997 | Willett | |
| 5,987,646 | A | 11/1999 | Bolmer | |
| 6,457,181 | B1 * | 10/2002 | Grundy | A41D 19/01582 2/163 |
| 7,051,377 | B1 | 5/2006 | Milner | |
| 8,763,162 | B2 * | 7/2014 | LoMedico | A41D 13/082 2/20 |

(Continued)

*Primary Examiner* — Katherine M Moran

(74) *Attorney, Agent, or Firm* — Brennan, Manna & Diamond, LLC

(57) ABSTRACT

The present invention relates to a novel better grip glove. The device is designed to fill the gap or space between the palm of the hand and the handle or other equipment to increase swing speed and improve other mechanics. The glove includes a specialized glove and a wedge-like insert that extends over the thumb and onto the palm of the hand. The insert conforms to the user's hand and the handle. The insert component is thicker near the thumb and first finger and decreases in thickness as it approaches the palm of the hand. Users can easily place the specialized batting glove on the hand to eliminate the gap between the hand and the handle to improve mechanics.

16 Claims, 7 Drawing Sheets

(56) References Cited

U.S. PATENT DOCUMENTS

| | | | | |
|---|---|---|---|---|
| 10,212,976 | B2 * | 2/2019 | Bailey | A63B 71/148 |
| 11,844,384 | B1 * | 12/2023 | Price | A41D 19/01588 |
| 2021/0197066 | A1 * | 7/2021 | Williams | A63B 71/146 |

* cited by examiner

GRIP SPORTING ACCESSORY

CROSS-REFERENCE TO RELATED APPLICATION

The present application claims prior to, and the benefit of, U.S. Provision Application No. 63/342,682, which was filed on May 17, 2022, and is incorporated herein by reference in its entirety.

FIELD OF THE INVENTION

The present invention relates generally to the field of athletic equipment and accessories. More specifically, the present invention relates to a better grip glove that allows users to utilize a wedge-like insert to eliminate or reduce the gap between the palm of the user's hand and the handle of the sporting equipment, such as a bat, golf club or racket. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in sporting gloves. Standard athletic gloves can be helpful in gripping the handle of sporting equipment but allow a gap between the palm of the hand and the handle of the equipment. The gap with traditional sporting gloves can affect or otherwise impact the swing mechanics, grip on the handle, and swing speed resulting in a less powerful swing. Furthermore, although a standard athletic glove may allow the grip to be improved, a gap between the palm of the hand and the handle still exists for many athletes such as baseball and softball players, golfers, tennis players and other racquet-based sports. This can negatively affect the grip on the handle, which negatively affects mechanics and swing speed.

As stated supra, although various sporting or athletic gloves, such as batting gloves, are generally effective at improving a players' grip, they do not serve the intended purpose of filling the gap or space between the palm of the hand and the handle of sporting equipment when the user is gripping the handle of the sporting equipment. As such, the disclosed sporting or athletic gloves relate to improved sporting gloves, or to an accessory for sporting gloves, which acts to ameliorate the above-described negative impacts on a player's swing or grip on the handle of the sporting equipment.

Thus, it is necessary for users to have a more effective means for reducing or eliminating the gap or space between the palm of the hand and the handle of sporting equipment, which will result in a more powerful swing and better handling of the sporting equipment. Generally, sporting gloves are a standard thickness throughout the glove and do not have any extra material in the area between the thumb and palm of the hand. However, many users need a glove that will eliminate or fill the gap or space between the palm of the hand and the handle. Therefore, users require a glove which includes a shim, spacer, filler, or other similar material that is located in the area between the thumb and palm of the hand that eliminates or fills the gap or space between the palm of the hand and the handle.

Therefore, there exists a long-felt need in the art for a better grip accessory that provides users with a wedge or shim-like insert that will fill the gap or space between the area of the palm of the hand and the handle of sporting equipment when the user is gripping the handle of the equipment. There is also a long-felt need in the art for a device that offers an adjustment to gloves or similar accessories without interfering with the swing or preparation routine. Further, there is a long-felt need in the art for a better grip device that features multiple types of materials including rubber, silicone, and other suitable materials that allows the gap or space between the handle or sporting equipment and the user's hand to be eliminated without compromising swinging or other mechanics. Moreover, there is also a long-felt need in the art for a better grip device that allows users to improve swing speed and grip on the handle or sporting equipment without compromising the swing or other mechanics needed to participate in the sporting activity.

The subject matter disclosed and claimed herein, in one embodiment thereof, comprises a better hand grip device. The device is designed to reduce or eliminate the gap between the palm of the hand and the handle or other sporting equipment, such as a bowling ball, when the user is gripping the equipment. The device is comprised of a rubber, silicone, or other suitable synthetic material or combination thereof that includes a shim or wedge-like insert in the space between the thumb and palm of the hand. The device is typically thicker near the thumb and tapers in thickness as the device approaches the palm of the hand. The invention is thinnest near the center of the palm of the hand. The invention allows users to improve swing speed and grip on the handle or other sporting equipment to maintain optimal mechanics while using the shim or wedge-like insert. Users can easily maintain a strong grip and swing mechanics while engaging in the sporting activity using this device.

In this manner, the better grip device of the present invention accomplishes all of the foregoing objectives and provides users with a device that improves overall grip on the handle or other sporting equipment, maintains swing or handling mechanics, and improves swing speed or other performance attributes. The device allows a user to fill the gap or space in the area between the palm of the hand and the handle or sporting equipment while swinging the equipment. The device offers a small adjustment to gloves and other hand gripping assemblies without interfering with the swing or other routine.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a better grip or handling device. The invention is designed to eliminate the gap or space between the palm of the hand and the handle or sporting equipment when the user is gripping the handle or sporting equipment. The invention includes a deformable component, such as a rubber or silicone wedge-like insert, in the space between the thumb and palm of the hand. At the base of the thumb, the invention is thicker, but narrows in width and as it approaches the adductor pollicis (which is the muscle between the thumb and first finger). The invention tapers in thickness but becomes three times as wide as the over-thumb component. The device allows users to improve swing speed and grip on the sporting equipment to maintain optimal mechanics while using the insert. Users can easily maintain a strong grip and swing mechanics while engaging in the sporting activity when using the present invention.

As stated supra, the better grip device of the present invention is configured to function as an adjustable shim or wedge-like insert in an athletic glove. The insert includes an over-thumb component and a palmar component that begins over the base of the thumb and extends over the adductor pollicis of the hand or the "webbing" of the hand. The palmar component covers, protects, and provides cushioning to the area between the thumb and the index finger while eliminating the space between the handle or other sporting equipment and the palm of the hand. In one embodiment, the better grip glove is a component that can be worn with or inserted into any athletic glove and is an add-on component or additional accessory element. In another embodiment, the better grip device is manufactured together as one piece and the insert is sewn into or permanently fixed in the glove.

In one embodiment, the better grip device comprises both a flexible, tacky covering of the entirety of the hand in the form of a glove, with a separable fastening connected to the covering of the hand at the wrist, along with a flexible wedge-like insert that has an over-thumb element and a palmar element. The over-thumb element creates an arch over the base of the thumb and connects to the palmar element. The palmar element is located on the palmar side of the hand and extends over the adductor pollicis muscle and then extends to the base of the first finger. The flexible insert begins over the base of the thumb and is narrow in width. Then, the flexible insert extends over the base of the thumb and has an oval shape that extends between the adductor pollicis and the base of the first finger. However, it should be understood that the insert can be any suitable shape and size as is known in the art, depending on the preferences of a user. The insert and athletic glove include components of varying breathability, flexibility, and stiffness. Any number of types of material with varying degrees of pliancy can be utilized with the device, depending on the preferences of a user.

In another embodiment, the athletic glove of the present invention comprises a glove covering the palmar side, dorsal side, and a plurality of finger portions and a thumb portion. In addition, the invention includes a guide for locating the handle or other element over the flexible insert over the thumb and adductor pollicis of the hand that extends to the base of the first finger. This insert encourages the handle to fall directly against the insert, which both eliminates a gap or space between the handle and the hand and also prevents the handle from falling against the adductor pollicis of the hand directly. While the invention has been described as an accessory for sporting activities, it should be understood that the invention may be used with canes, walkers, wheelchairs and other items where it would be beneficial for the user to more fully grasp the item they are using.

In another embodiment, the better grip glove is placed on the user's hand through the opening at the base of the glove. The user's hand slides through the opening of the glove and the user places each finger into the corresponding finger portions or components. The flexibility of the material that makes up the glove allows the glove to fit tightly over the user's hand. Then, the deformable, wedge-like insert component will fit over the thumb as the user places the thumb in the corresponding thumb opening of the glove as the insert is secured in the glove. The insert will continue to rest on the palmar side over the hand and adductor pollicis muscle and extend between the base of the thumb and base of the first finger. The inherent flexibility of both the glove component and the wedge-like insert allows for movement of the hand to grasp the handle of the sporting goods and to also simultaneously eliminate the gap or space between the palm of the hand and the bat. The handle of the equipment will be able to rest on the wedge-like insert allowing the hand to grasp the handle with ease and eliminate the space or gap between the hand and the bat handle.

More particularly, the wedge-like insert is either sewn or fixed by other means such as adhesive, into the glove.

Further, when the better grip device is placed in an operative configuration with the hand (wearing the better grip device) grasping the handle of the bat, racquet, club or other sporting goods such as a ball, the better grip device is positioned to allow the insert to fill the gap or space between the palm of the hand and the handle or sporting equipment. With the insert positioned as defined with the user resting the handle on the insert, the user will reduce or eliminate the space between the handle and the hand of the user. Thus, the insert is correctly positioned to allow finger-tip control of the handle such that as the user begins, continues, and finishes the swing or other movement, the swing mechanics can be maintained as the proper grip is maintained infusing more power into the swing. Conversely, a palm grip would decrease a user's power and make a pop-out more likely.

In one embodiment, the glove may be formed of leather or other flexible synthetic material in order to provide increased frictional gripping strength between the glove and the handle or other sporting equipment. Further, the wedge-like insert may be formed using a deformable material such as rubber, silicone, polystyrene, polyurethane, or any other suitable synthetic polymer material or combinations thereof as is known in the art, such that it is effective in allowing flexibility of the insert to conform between the user's hand and the handle or sports equipment, while still maintaining its thickness to fill the gap or space between the user's hand and the handle or sports equipment. In differing embodiments the outer edges of the wedge can have a softer material since the edges will be in contact with the hand to reduce blistering and the inner or central portion may be a firmer yet deformable material so that the space or gap is not depressed too much to lose any gripping tension between the hand and the handle of the sporting equipment.

In another embodiment, the overall dimensions of the better grip device may vary greatly and, in particular, may be determined based on the preferences of the individual. Generally, in this regard, the width of the over-thumb element is half the length of the user's metacarpal bone or about a range of 39.2 to 56.9 mm with about 45 mm to 49 mm being preferred. The palmar element may be approximately dimensioned to extend four to six centimeters along the semi-major axis and two to four centimeters along the semi-minor axis.

In one embodiment, a separable fastening device is located at the opening of the glove which will allow the better grip device to be securely attached to the user's wrist. The separable fastening device surrounds the opening at the base of the glove opposite the plurality of finger components such that the separable fastening device, when in use, can securely attach to the user's wrist. Any suitable separable fastening device can be utilized as is known in the art, depending on the preferences of the user.

In yet another embodiment, the better grip device includes a plurality of indicia or graphics.

In yet another embodiment, a method of eliminating the gap or space between the palm of the hand and the handle or sporting equipment is described. The method includes the steps of implementing a better grip invention comprising a glove and a shim or wedge-like insert having an over-thumb element and a palmar element.

In use, when actively using the sporting equipment, the better grip glove will be placed into its operative configuration and the glove is placed over the hand. The shim or wedge-like insert will fit over the thumb as the user places the thumb in the corresponding thumb opening of the glove as the insert is secured in the glove. The insert will continue to rest on the palmar side over the hand and adductor pollicis muscle and extend between the base of the thumb and base of the first finger so that the better grip device will serve to eliminate the gap or space between the handle and the user's hand. The user's swing speed and mechanics will be positively affected. Further, the insert is manufactured from flexible but firm material allowing the insert to form against both the handle and the user's hand while still maintaining its thickness to fill the gap between the user's hand and the handle. Maintaining the gap or space between the user's hand and the handle or sporting equipment allows proper grip while not sacrificing swing mechanics, thus maintaining or improving the user's grip and swing speed.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
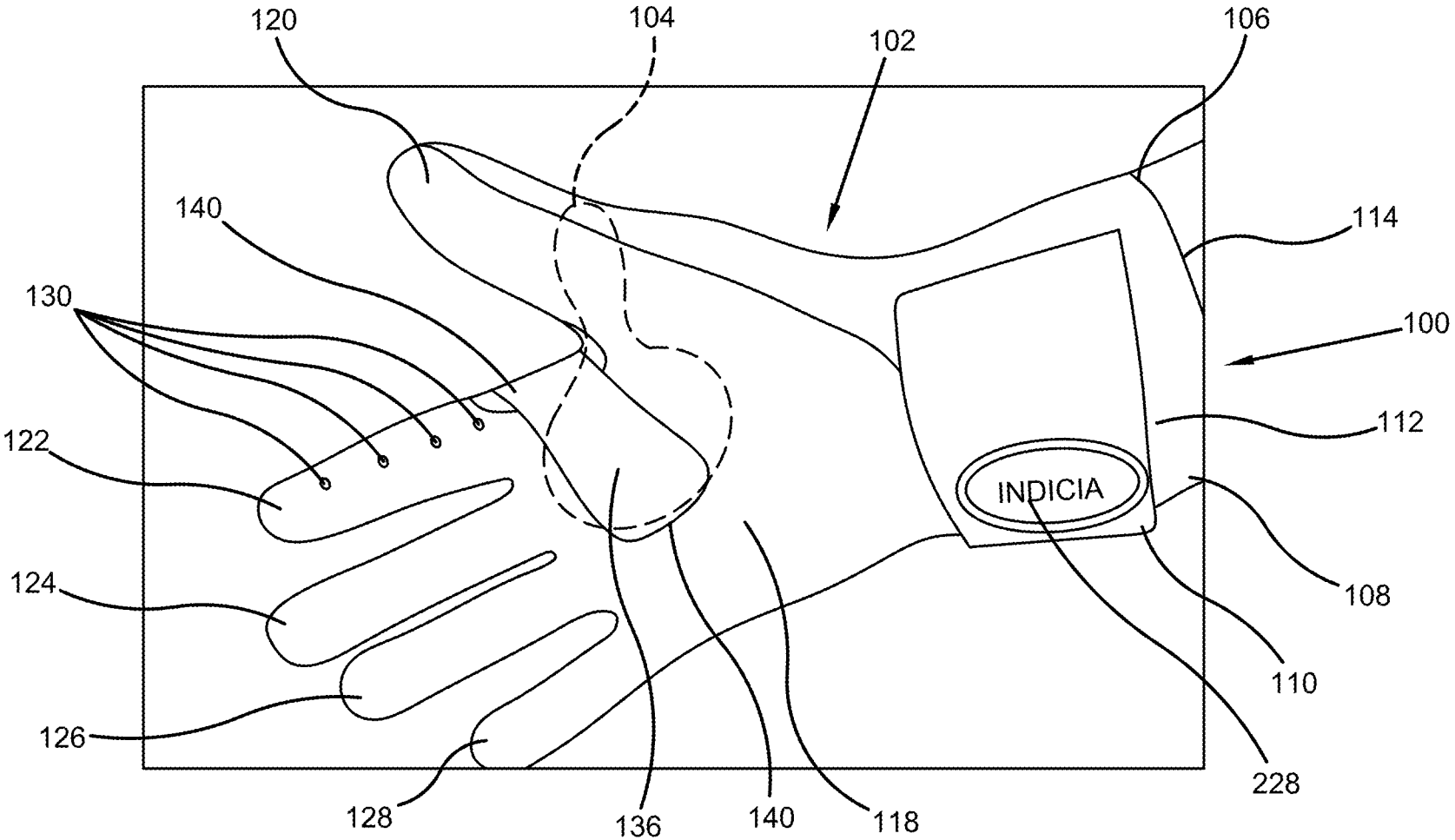
FIG. 1 illustrates a perspective view of one potential embodiment of the grip sporting accessory of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a better grip athletic accessory that provides users with a wedge-like insert that will fill the gap or space between the palm of the hand and the handle or other sporting equipment when the user is gripping the item. There is also a long-felt need in the art for a device that offers an adjustment to gloves without interfering with the individual's swing or other warmup routine. Further, there is a long-felt need in the art for a better grip device that can feature multiple types of materials including rubber, silicone, polystyrene, polyurethane, foam, other suitable materials and combinations thereof that allows the gap or space between the handle or the sporting equipment and the user's hand to be eliminated without compromising swinging mechanics or other performance attributes. Moreover, there is also a long-felt need in the art for a better grip device that allows users to improve swing speed and grip on the handle or other sports equipment without compromising performance attributes of the individual.

The present invention, in one exemplary embodiment, a novel better grip glove is provided. The device is designed to fill the gap or space between the palm of the hand and the handle when the user is gripping a handle such as a bat, racquet, stick or club or gripping a ball. The insert is manufactured from a deformable material such as polystyrene, polyurethane, rubber, silicone, other suitable synthetic material or combinations thereof, and is provided in a wedge-like insert at the thumb and palm of the hand. The invention is thicker near the thumb and tapers in thickness as the device approaches the palm of the hand. The device is thinnest near the center of the palm of the hand. The device allows users to improve swing speed and grip on the sporting equipment to maintain optimal mechanics while using the invention. Users can easily maintain a strong grip and swing mechanics while using this device. The present invention also includes a novel method of maintaining the grip on the sports equipment and increasing swing speed to maintain optimal performance mechanics. The method includes the steps of initially providing a better grip glove comprising a glove having an insert at the arch of the thumb that extends between the base of the first finger and the adductor pollicis. The method also includes the steps of positioning the glove over the user's hand, allowing the insert to fall over the arch of the thumb and extend between the base of the first finger and the adductor pollicis, and fastening layer one of the separable fastening device to layer two of the separable fastening device at the user's wrist. The method further includes positioning a user's hand over the insert to fill the gap or space between the palm of the hand and the handle or sporting equipment when the user is gripping the item. As previously indicated, the glove may also be used in connection with walkers, canes, and wheelchairs to allow the individual to have a better grip on those momentum devices.

Referring initially to the drawings, FIG. 1 illustrates a perspective view of one embodiment of the better grip device 100 of the present invention. In the present embodiment, the better grip device 100 is an improved athletic accessory device that eliminates the gap or space between the palm of the hand and the handle or other sports equipment, which serves to improve swing speed, performance and grip, while also maintaining swing mechanics. The device 100 is especially designed to allow any suitable user as in known in the art, to easily and properly grip the handle while maintaining or improving both swing speed and swing mechanics. More specifically, the device 100 comprises a glove 102 with a wedge-like insert component 104. The wedge-like insert component 104 has an over-thumb element 132 and palmar element 134. Users can easily secure the glove 102 and the shim or wedge-like insert component 104 by placing the glove 102 on the hand and fastening it by connecting one layer of the separable fastening device 108 with the second layer of the separable fastening device 110.

As stated supra, the glove component 102 of the present invention is configured to the user's hand and will vary depending upon the size of the user's hand and can be any suitable shape and size as is known in the art, depending on the preferences of a user. The glove component 102 comprises a main opening 114, a dorsal side covering 116 and a palmar side covering 118. The glove also has a thumb opening or component 120, first finger component 122, second finger component 124, third finger component 126, and fourth finger component 128, which allows each of the user's fingers to be placed in the corresponding finger component or opening. Each finger component or opening possesses four to six breathability elements 130. The wedge-like insert 104 has a first portion or an over-thumb element 132 and a second portion or palmar element 134. The palmar padding element 134 is located on the palmar side of the hand 214 near the base of the first finger 214 and the adductor pollicis muscle 220. In one embodiment, the shim or wedge-like insert 104 of the device 100 is a glove as is known in the art and the shim or wedge-like insert 104 is an additional element that can be sewn or otherwise attached to the glove, such as with adhesive or magnetic attachment so that it can be easily removed when not in use. The shim or wedge-like insert can be secured to the glove component 102 via any suitable means, such as being sewn into the glove, secured by other means such as adhesive or magnets, or even worn outside of a glove. When worn outside the glove, the wedge may be secured by a removable or repositionable adhesive or have magnetic attachment element, with one magnet permanently embedded in the glove and the wedge having a corresponding magnet. In a further embodiment, the wedge may be attached by a hook and loop type of fastening system. In another embodiment, the shim or wedge-like insert 104 and the glove component 102 are manufactured together as one integral piece.

As shown in FIG. 1, the glove component 102 has a wristband component 106, which includes a band component 112. The band component 112 begins on the wrist near the palmar side of the hand 216 where layer one of a separable fastening device 108 is located; then, the band loops around the wrist 200 and layer two of a separable fastening device 110 connects on top of layer one 108 to securely fasten the glove against the user's wrist 200. Any suitable fastening component can be utilized such as hook and loop, snaps, and/or buckles depending on the preferences of a user.

Furthermore, specifically relating to the shim or wedge-like insert 104 (shown in FIG. 4), it is generally formed from one contiguous piece of deformable or configurable polystyrene, polyurethane, rubber, silicone, polymer-based material, other suitable material or combinations thereof as is known in the art. The shim or wedge-like insert 104 has two elements including an over-thumb element 132 and a palmar element 134. Regarding the over-thumb element 132, it begins on the outside of the metacarpal bone 222 of the user's thumb 204 closest to the dorsal side of the hand 218. The over-thumb element 132 arches over the metacarpal bone 222 of the user's thumb 204 to the other side of the metacarpal bone 222 closest to the palmar side of the hand 216. The over-thumb element 132 is relatively narrow, but consistent in width or thickness which can range from about 1 cm to about 5 cm with about 1-3 cm being preferred, depending on the size of the hand of the individual and the form of the hand. The over-thumb element 132 can be any suitable shape and size as is known in the art, depending on the preferences of a user. The over-thumb element 132 then connects to the first or palmar element 134. Regarding the first or palmar element 134, it is oval-shaped and extends to the edge of the user's hand near the first finger 206. The bottom edge of the palmar element 140 does not reach the base of the second finger 226. The palmar element 134 extends over the adductor pollicis muscle 220 and to the base of the first finger 214.

The shim or wedge-like insert 104 also decreases in thickness through the palmar element 136 of the insert; it is thickest closer to the edge of the user's hand near the first finger 224. The wedge-like insert 104 decreases in thickness as it approaches the adductor pollicis muscle 220. Both the over-thumb element 132 and the palmar element 134 have components of varying dimensions, allowing a user to customize the shim or wedge-like insert 104 to the desired size and flexibility to fit the hand of the wearer. The wedge or shim shaped insert may be positioned on an interior of the glove, or provided on the exterior of the glove. In either instance the wedge may be permanently or removably attached to the glove.

Figure 7:
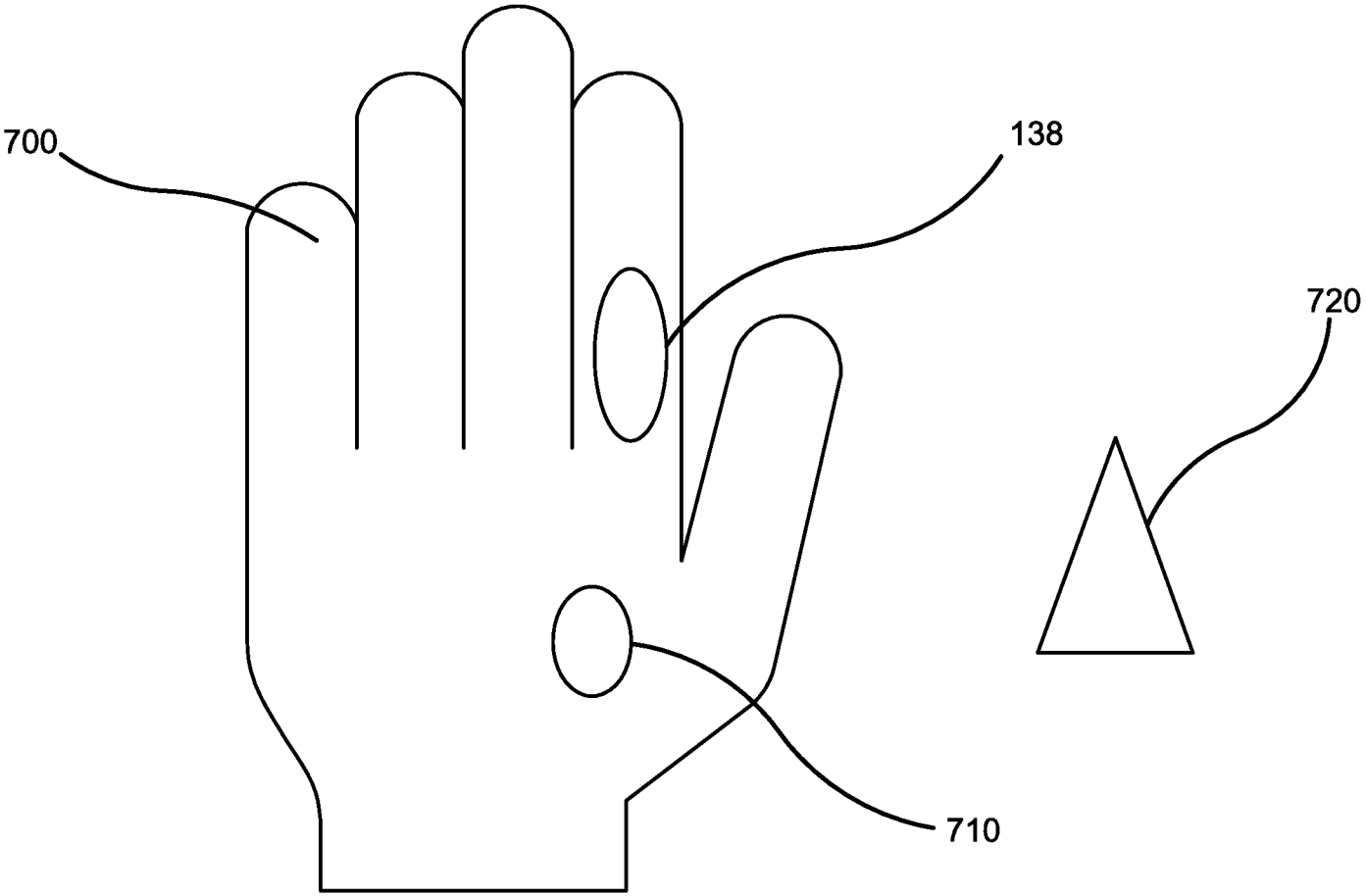
FIG. 7 illustrates a perspective view of one potential embodiment of the grip device of the present invention positioned external of the glove and with an attachment mechanism in accordance with the disclosed architecture.

More particularly, the ability for fixing the wedge-like insert 104 in the glove 102 may include both the palmar padding element 136 and the first finger padding element 138 (see FIG. 7). The wedge-like insert 104 is positioned in a configuration in which it extends to the base of the first finger 214 and over the adductor pollicis muscle 220. To secure the shim or wedge-like insert 104 in the glove 102, the means may include sewing, gluing, mechanical fasteners, or other means or combinations of permitting the wedge-like insert 104 to be permanently or removably fixed in the glove 102.

Figure 2:
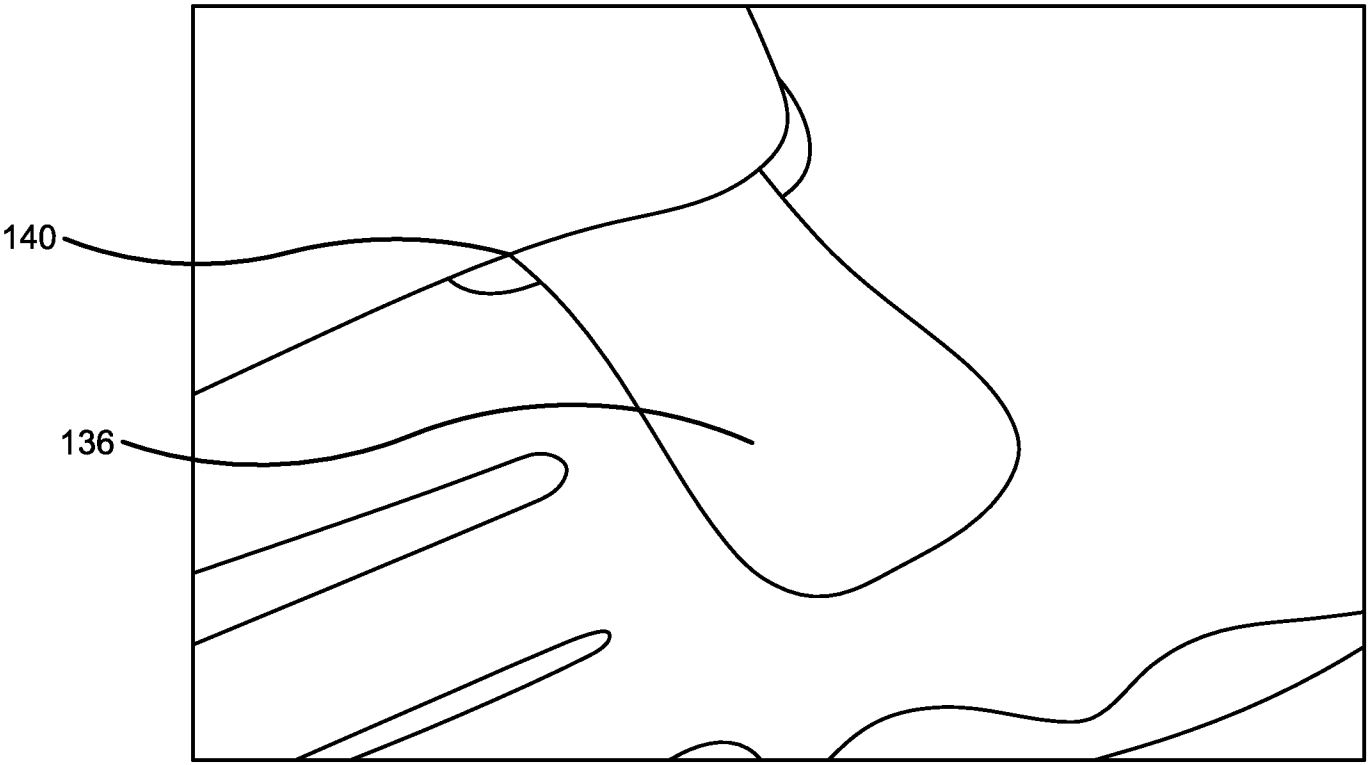
FIG. 2 illustrates a perspective view of one potential embodiment of the grip device of the present invention, wherein a close-up view of the shim or wedge-like insert and palmar padding element is present within the athletic glove in accordance with the disclosed architecture.
Figure 3:
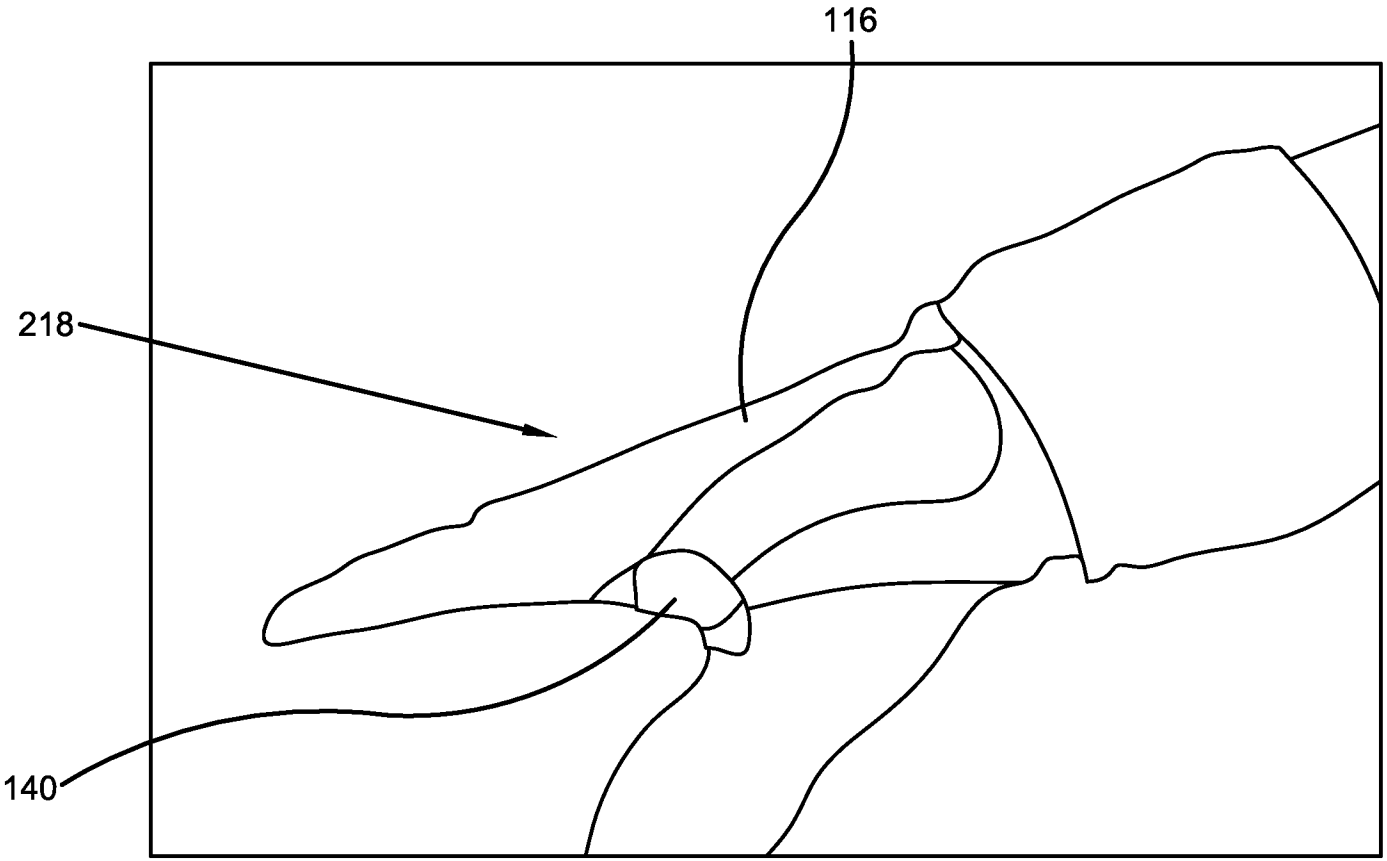
FIG. 3 illustrates a perspective view of one potential embodiment of the grip device of the present invention, wherein a side view of a right-handed glove with the wedge-like insert is shown in accordance with the disclosed architecture.

As shown in FIG. 2, the shim or wedge-like insert 104 is positioned in operative configuration with the shim or wedge-like insert positioned over the adductor pollicis muscle 220 to serve to fill the gap between the palm of the hand and the handle, while allowing the user to improve swing speed and maintain proper swing or other performance mechanics. As shown in FIG. 3, the first finger padding element 138 allows the user to rest the handle between the wedge-like insert 104 and the first finger padding element 138, which permits the user's fingertips to grasp the handle or other sporting equipment or mobility assist properly and at a comfortable angle to assist with maintaining proper swing mechanics or other use or performance.

In one embodiment, the shim or wedge-like insert component 104 may be formed of polyurethane, polystyrene, rubber, silicone, plastic, any other suitable synthetic plastic material, or combination thereof known in the art. In one embodiment, the glove component 102 may be formed of leather, nylon, or other synthetic fabric known in the art.

Further, the overall dimensions and the better grip device may be greatly variable and, in particular, may be determined based on the preferences of a user. Generally, in this regard, both the glove component 102 and the shim or wedge-like insert 104 of the better grip device may be greatly variable and, in particular, may be determined based on the size of the hand of the user. Further, the overall dimensions of the wedge-like insert 104 may be approximately dimensioned to extend between 20 mm and 60 mm for the over-thumb element 132; as to the palmar element 134, it may be approximately dimensioned to be 30 mm to 80 mm on the semi-major axis and 20 mm to 60 mm on the semi-minor axis.

In yet another embodiment, the better grip device 100 has a plurality of indicia 224. The glove component 102 may include advertising, a trademark, or other letters, designs, or characters, printed, painted, stamped, sewn, or otherwise integrated into the glove component 102, or any other indicia 224 as is known in the art. Specifically, any suitable indicia 224 as is known in the art can be included, such as, but not limited to, patterns, logos, emblems, images, symbols, designs, letters, words, characters, animals, advertisements, brands, etc., that may or may not be baseball, softball, sports or brand related.

Figure 4:
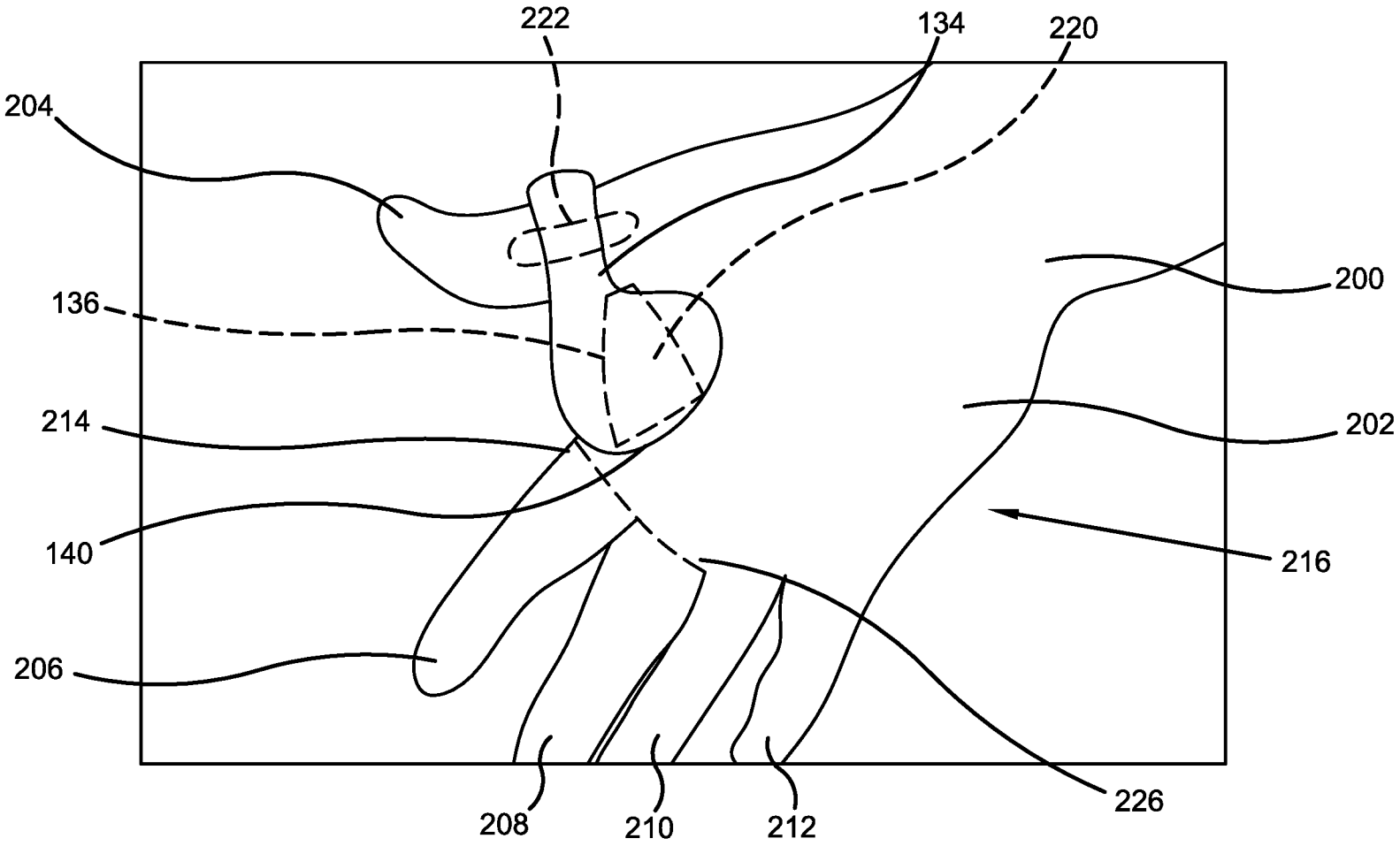
FIG. 4 illustrates a perspective view of one potential embodiment of the grip device of the present invention, wherein the shim or wedge-like insert is positioned on an exposed right hand (without the presence of the glove) in accordance with the disclosed architecture.

As also shown in FIG. 4, the shim or wedge-like insert 104 is shown separately from the glove 102. When the wedge-like insert 104 is in its operative configuration, it is correctly positioned with the over-thumb element 132 arching over the base of the thumb and the palmar element 134 extending from the base of the first finger 214 to the adductor pollicis 220. When positioned in this manner, the device 100 will serve as an effective device to eliminate the gap or space between the handle or other sporting equipment and the palm of the hand while also allowing the user to maintain proper swing or other performance mechanics and improve speed and grip on the handle or other sporting equipment. As the user's thumb 204 grasps the handle, the over-thumb component 132 will press against the handle allowing the user to firmly grasp the handle and also eliminate any gap or space between the hand and the handle. The palmar element 134 will also press against the handle. When in operative configuration, the edge of the user's hand near the first finger 224 and the bottom edge of the palmar element 140 will be perpendicular to the handle.

Figure 5:
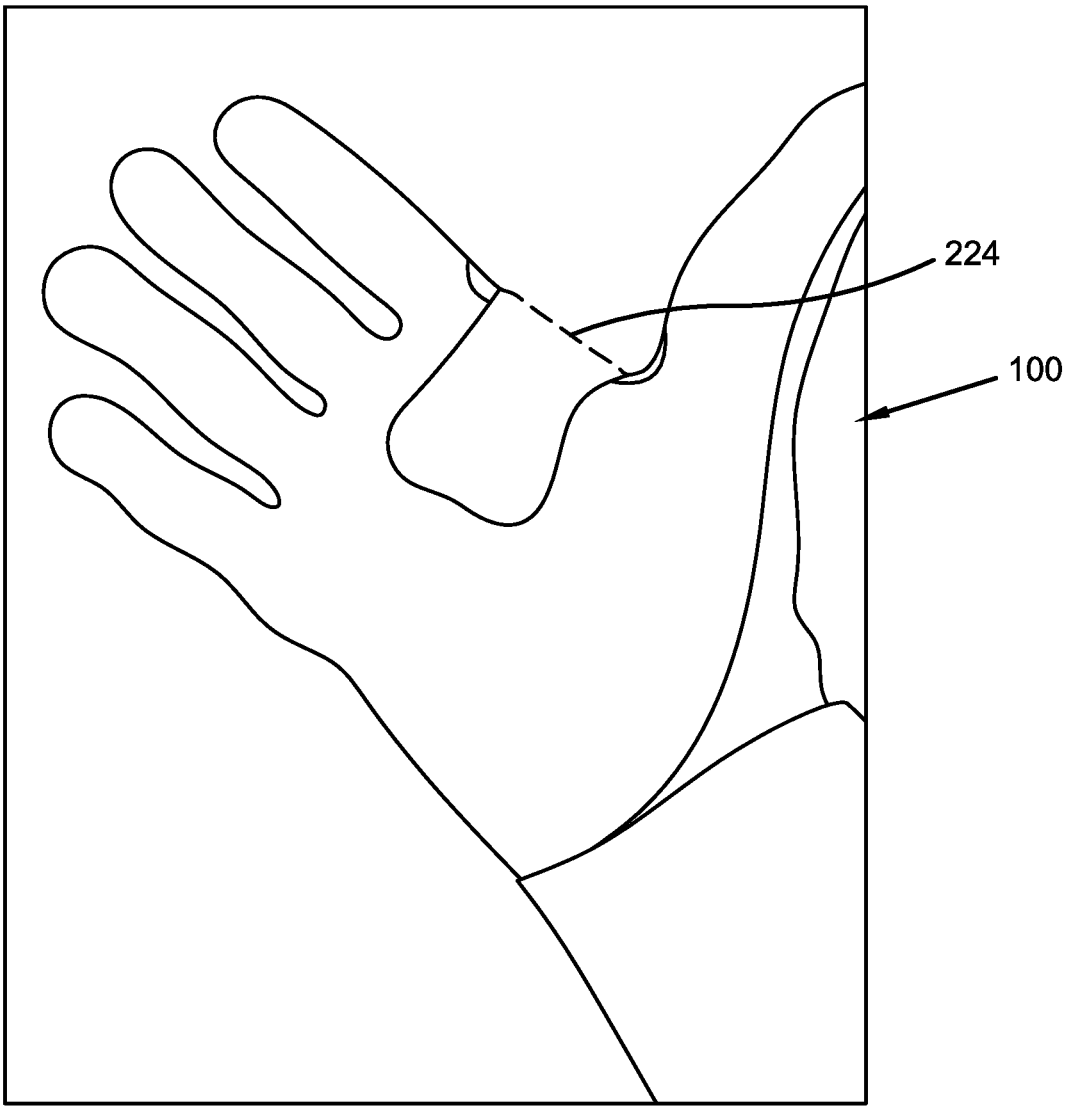
FIG. 5 illustrates a perspective view of one potential embodiment of the grip device of the present invention in use on a user's right hand in accordance with the disclosed architecture.

FIG. 5 illustrates a palmar view of the user's hand with the wedge-like insert 104 sewn or fixed in the glove 102. The palmar padding element 136 shows the location of the wedge-like insert 104 on the palmar side of the hand 216. The method includes the steps of at 600, providing a better grip device having an insert at the arch of the thumb extending between the base of the first finger and the adductor pollicis. The method also includes at 602, positioning the glove over the user's hand, allowing the insert to fall over the arch of the thumb extending between the base of the first finger and the adductor pollicis, and fastening layer one of the separable fastening device 108 to layer two of the separable fastening device 110 at the user's wrist 200. The method includes the step of positioning a user's hand over the insert to fill the gap between the palm of the hand and the handle when the user is gripping the handle.

Figure 6:
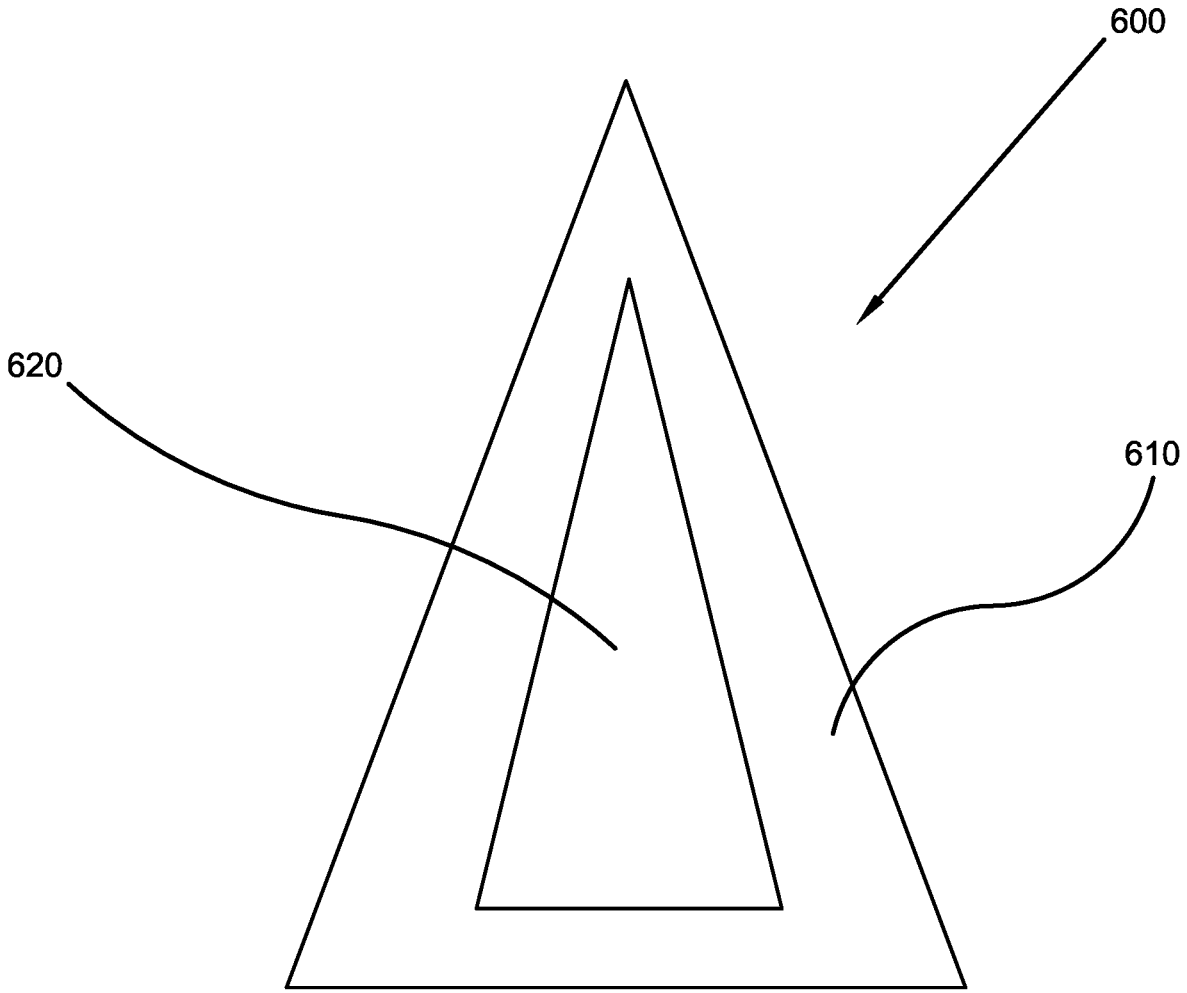
FIG. 6 illustrates a perspective view of the shim or wedge-shaped insert of the present invention in accordance with the disclosed architecture.

FIG. 6 shows the insert 600 with a softer material 610 around the exterior or perimeter of the wedge 600 and a firmer material 620 on the interior of the wedge-shaped piece.

FIG. 7 shows the glove 700 of the present invention with an attachment component 710 positioned on the palm of the glove 700 and the wedge or shim shaped piece 720 unattached to the glove 700. The wedge or shim shaped piece 720 may be attached by adhesive, such as a removable or repositionable adhesive, hook and loop fastener or magnetic attachment.

Certain terms are used throughout the following description and claims to refer to particular features or components. As one skilled in the art will appreciate, different users may refer to the same feature or component by different names. This document does not intend to distinguish between components or features that differ in name but not structure or function. As used here "better grip batting device" and "device" are interchangeable and refer to the better grip batting device 100 of the present invention. All dimensions referenced herein are inclusive.

Notwithstanding the foregoing, the better grip batting device 100 of the present invention can be of any suitable size and configuration as is known in the art without affecting the overall concept of the invention, provided that it accomplishes the above-stated objectives. One of ordinary skill in the art will appreciate that the better grip batting device 100 as shown in the FIGS. are for illustrative purposes only, and that many other sizes and shapes of the better grip batting device 100 are well within the scope of the present disclosure. Although the dimensions of the better grip batting device 100 are important design parameters for user convenience, the better grip batting device 100 may be of any size that ensure optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A sporting accessory comprising:

a glove having a palmar region, a plurality of finger components, a thumb component, a securing element to hold the glove to a hand of a user, and a wrist band component comprising a band comprising a first layer comprising a first separable fastener and a second layer comprising a second separable fastener configured to mate with the first separable fastener on a top of the first layer; and a wedge provided between the palmar region and at least one of the plurality of finger components, wherein the wedge is comprised of a thicker portion located near the palmar region as compared to a remainder of the glove, and further wherein of the wedge is configured to reduce a space or a gap between the glove and a sporting equipment item or a mobility assist item; and wherein the wedge further comprises an over-thumb element and a palmer element that is narrower than the over-thumb element.

2. The sporting accessory recited in claim 1, wherein the sporting equipment item is a select one of a bat, a racquet, a club or a ball.

3. The sporting accessory recited in claim 1, wherein the wedge is positioned on an exterior of the glove.

4. The sporting accessory recited in claim 1, wherein the mobility assist item is a select one of a walker, a cane or a wheelchair.

5. The sporting accessory recited in claim 1, wherein the wedge is removably attached to the glove.

6. The sporting accessory recited in claim 5, wherein the wedge is removably attached to the glove by an adhesive, a magnet or a hook and loop fastener.

7. The sporting accessory recited in claim 6, wherein the adhesive is one of a removable adhesive or a repositionable adhesive.

8. The sporting accessory recited in claim 1, wherein the wedge is attached to the glove via a sewing.

9. The sporting accessory recited in claim 1, wherein the wedge has a size ranging from 20 mm to 60 mm.

10. The sporting accessory recited in claim 9, wherein the wedge has a size ranging from 39.2 to 56.9 mm.

11. The sporting accessory recited in claim 1, wherein the wedge is comprised of a deformable material.

12. The sporting accessory recited in claim 1, wherein the wedge is comprised of a rubber, a silicone, a polyurethane, a polystyrene or a combination thereof.

13. A batting glove comprising:

a glove comprised of a plurality of finger components, a palmar component, and an indicia;

a wedge for positioning between the palmar component and a select one of the plurality of finger components, wherein the wedge is manufactured from a deformable material, is provided interiorly of the glove, and is configured to reduces a space between a hand inserted in the glove and a bat; and wherein the wedge comprises an over-thumb element and an oval palmer element that is narrower than the over-thumb element; and wherein the wedge is a polyurethane wedge magnetically securable to the glove.

14. The batting glove as recited in claim 13, wherein the wedge has a length ranging from 39.2 to 56.9 mm.

15. The batting glove as recited in claim 13, wherein the wedge has a thickness ranging from 1 to 5 cm.

16. A specialty glove for improving a player's swing mechanics, the specialty glove comprising:

a glove; and a deformable wedge provided between a palmar region and a finger region of the glove, wherein the deformable wedge has a length ranging from 20 mm to 60 mm, and further wherein the wedge is configured to fill a space or gap between a handle and a hand of the player; and wherein the deformable wedge comprises an over-thumb element and an oval palmer element that is narrower than the over-thumb element; and wherein the deformable wedge further comprises a perimeter comprising a first material and an interior portion comprising a second material that is firmer than the first material.

* * * * *